US008783001B2

(12) United States Patent
Sikorcin

(10) Patent No.: US 8,783,001 B2
(45) Date of Patent: Jul. 22, 2014

(54) BALLOON FILLING DEVICE

(75) Inventor: Wayne Sikorcin, Lisle, IL (US)

(73) Assignee: Tie Not Incorporated, Lisle, IL (US)

( * ) Notice: Subject to any disclaimer, the term of this patent is extended or adjusted under 35 U.S.C. 154(b) by 863 days.

(21) Appl. No.: 12/965,036

(22) Filed: Dec. 10, 2010

(65) Prior Publication Data

US 2012/0144776 A1 Jun. 14, 2012

(51) Int. Cl.
*B65B 7/02* (2006.01)
*A63H 27/10* (2006.01)

(52) U.S. Cl.
CPC ..... *A63H 27/10* (2013.01); *A63H 2027/1033* (2013.01)
USPC ..... 53/266.1; 53/79; 53/558

(58) Field of Classification Search
CPC ..... A61H 27/10; B65B 7/02
USPC ..... 53/266.1, 284.7, 79, 285, 558, 705
See application file for complete search history.

(56) References Cited

U.S. PATENT DOCUMENTS 3,547,147 A * 12/1970 Shay ..... 137/522
3,701,478 A * 10/1972 Tada ..... 239/333
3,985,140 A * 10/1976 Harris ..... 604/9
4,390,188 A * 6/1983 Rouse ..... 280/6.159
4,580,596 A * 4/1986 Stehling ..... 137/523
4,588,394 A * 5/1986 Schulte et al. ..... 604/9
4,605,200 A * 8/1986 Huppee ..... 251/258
4,662,871 A * 5/1987 Rafelson ..... 604/119
4,940,459 A * 7/1990 Noce ..... 604/97.02
5,015,233 A * 5/1991 McGough et al. ..... 604/97.03
5,669,879 A * 9/1997 Duer ..... 604/99.04
5,860,947 A * 1/1999 Stamler ..... 604/19
6,419,657 B1 * 7/2002 Pacetti ..... 604/99.04
7,056,307 B2 * 6/2006 Smith et al. ..... 604/207
7,258,681 B2 * 8/2007 Houde ..... 604/246
8,066,713 B2 * 11/2011 DiMauro et al. ..... 606/94
8,097,014 B2 * 1/2012 Borkon ..... 606/193
8,235,256 B2 * 8/2012 Green et al. ..... 222/389
8,333,773 B2 * 12/2012 DiMauro et al. ..... 606/93
8,360,629 B2 * 1/2013 Globerman et al. ..... 366/288
8,361,078 B2 * 1/2013 Beyar et al. ..... 606/94
8,415,407 B2 * 4/2013 Beyar et al. ..... 523/117
8,486,011 B2 * 7/2013 O'Dea et al. ..... 604/99.03
8,491,462 B2 * 7/2013 Chechik ..... 600/40
8,540,722 B2 * 9/2013 Beyar et al. ..... 606/94
8,579,908 B2 * 11/2013 Mazzuca et al. ..... 606/93
8,695,311 B2 * 4/2014 Daigle et al. ..... 53/64
2014/0033645 A1 * 2/2014 Daigle et al. ..... 53/79

* cited by examiner

*Primary Examiner* — Gloria R Weeks
(74) *Attorney, Agent, or Firm* — Husch Blackwell LLP

(57) ABSTRACT

A balloon filling device is provided. The balloon filling device includes a hose connector extending outwards from a body of the balloon filling device, a hose barb extending outwards from the body along a predominant axis, the hose barb being displaced on the body from the hose connector, a valve within the body having an opened state where the valve forms a conduit between the hose connector and the hose barb and a closed state where the conduit is blocked and a receptacle disposed in the body adjacent the hose barb that receives a balloon tying device.

19 Claims, 5 Drawing Sheets

BALLOON FILLING DEVICE

FIELD OF THE INVENTION

The field of the invention relates to balloons and more particularly to devices for filling and tying balloons.

BACKGROUND OF THE INVENTION

The use of balloons at weddings and parties is well known. In such cases, balloons are often used as decorations or centerpieces. Sometimes, balloons may be used to line windows or the walls of homes or reception halls. Usually the balloons are brightly colored to add a sense of festival to the occasion.

Balloons can also be used for advertising. In this case, messages, trademarks or logos may be imprinted on an outer surface of the balloon to promote a product or simply enhance brand awareness. When used for advertising, the balloons may be given away at festivals or fairs.

Balloons may be provided in any of a number of sizes. Relatively small balloons may be provided for use as decoration. Larger balloons may be used for advertising. In some cases, balloons of several feet in diameter may be imprinted with a message and filled with helium so that they float. Such balloons may be tethered to the ground over businesses to attract attention to special events.

In the case of children, balloons may be provided as a source of amusement. For younger children, balloons may be used to play games (e.g., a faun of volleyball where the slow movement of the balloon is more adapted to the dexterity of the small child). Alternatively, a balloon may be filled with water for use with larger children and adults. When filled with water, such balloons may be used for water-fights on hot days.

While balloon have an almost infinite utility to both inform and amuse, they are labor intensive to fill and use. The balloon must first be inflated with some fluid. In many cases, a balloon is inflated by a person simply pressing his/her lips to a mouth of the balloon and blowing air into the balloon. Once filled, the neck of the balloon is simply tied into a knot. However, the step of tying the neck of a balloon into a knot is especially difficult for a young child or even for an adult. Because of the importance of balloons, better methods are needed for filling and for tying knots in the necks of balloons.

DETAILED DESCRIPTION OF AN ILLUSTRATED EMBODIMENT

Figure 1:
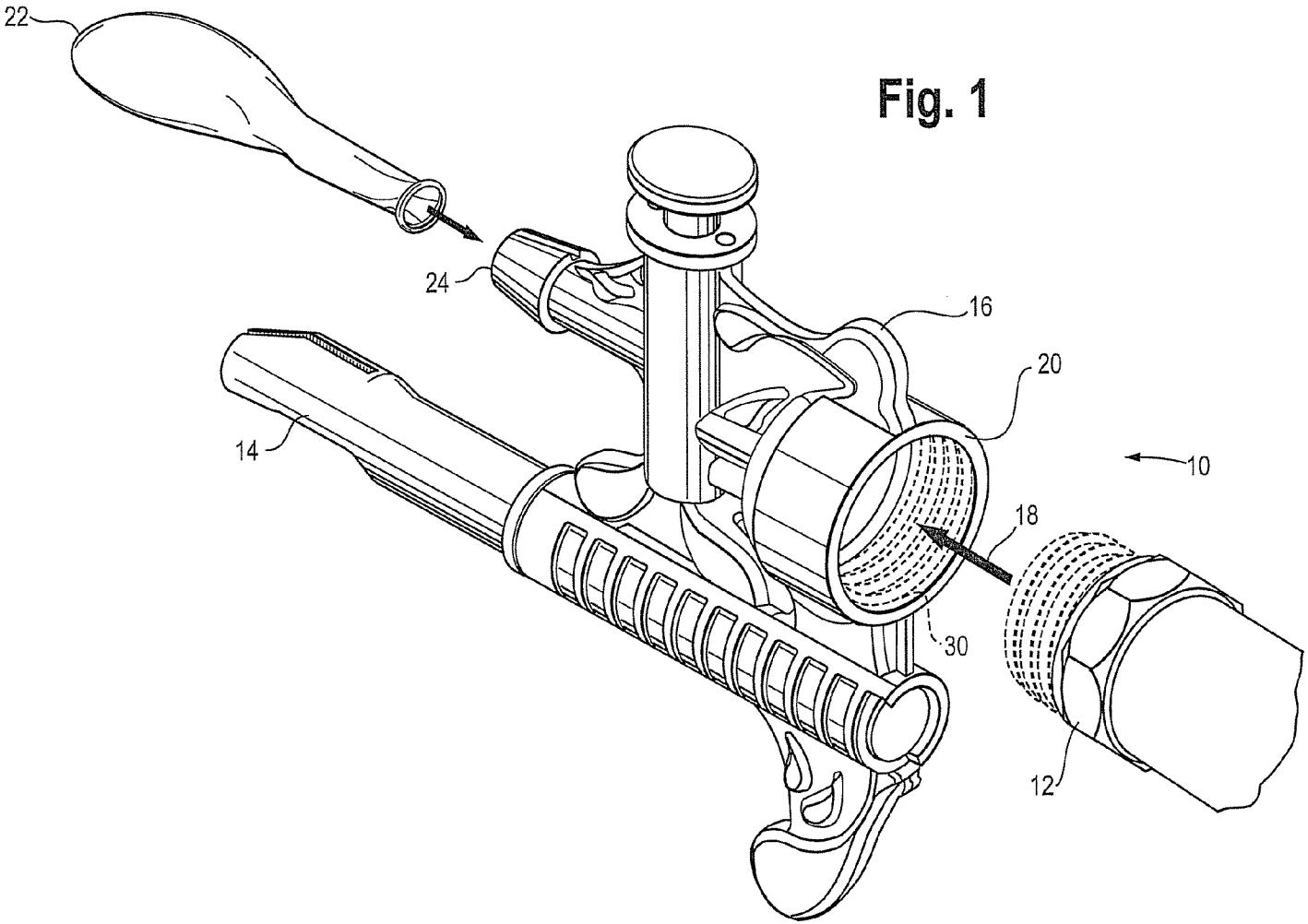
FIG. 1 is a side-perspective view of a balloon filling device shown generally in accordance with an illustrated embodiment of the invention.
Figure 3:
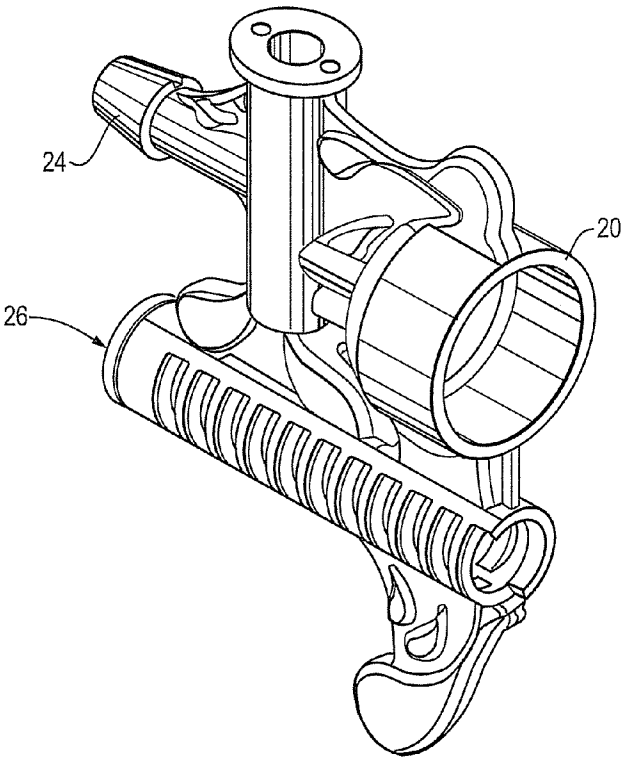
FIG. 3 is a side view of a body of the balloon filling device of FIG. 1.
Figure 2:
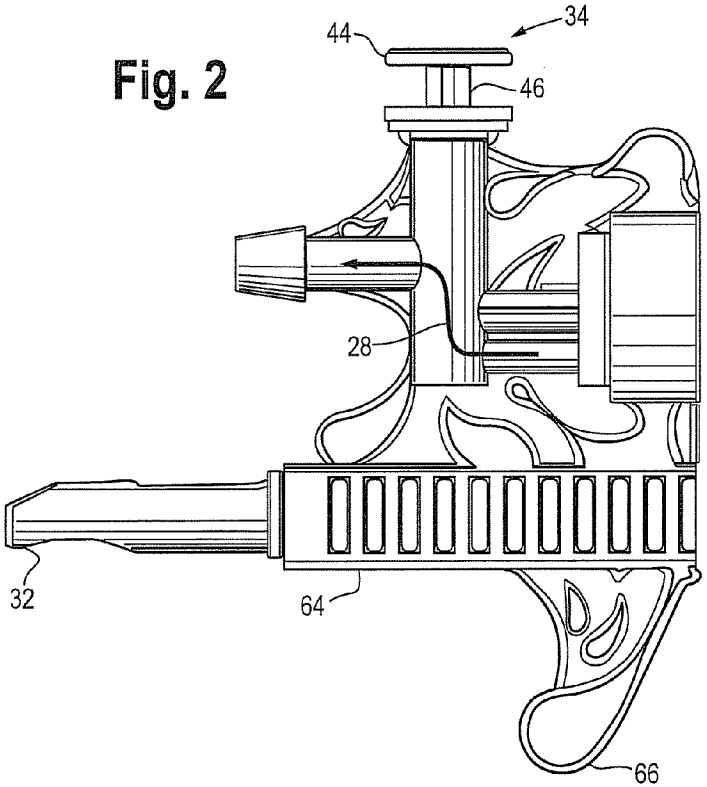
FIG. 2 is a side view of the balloon filling device of FIG. 1.

FIG. 1 is a side-perspective view of a device 10 for filling and tying pressurized flexible containers (e.g., balloons) 10 shown generally in accordance with illustrated embodiments of the invention. For example, the device 10 may be used for filling water balloons 22.

The filling and tying device 10 may include a body 16 and detachable balloon tying device 14. The detachable balloon tying device 14 may be removed from the body 16 and used separately for tying balloons.

The device 10 may be connected 18 to a source of pressured fluid, such as a garden hose 12 providing a pressurized fluid (e.g., water) and may use the pressure to fill the balloon with the fluid. In this case, an internal thread 30 of a female hose connector 20 may engage an external thread on a male end of the garden hose 12.

The tying device 10 generally includes the body or body 16 that supports the female hose connector 20, a fill tube (a hose barb) 24 and a finger grip 66. A receptacle 26 is provided to receive and rigidly secure the balloon tying device 14 to the body 16. The housing 16 includes the female hose connector 20 extending from a first end and the hose barb 24 extending from a second, opposing end. An internal channel or conduit 28 connects the female hose connector 20 to the hose barb 24.

The balloon tying device 14 may be coupled on a proximal end to the body 16 by inserting the proximal end into the receptacle 26 and with a distal end extending outwards alongside the fill tube 24. The fill tube 24 and tying device 14 may extend outwards from the body 16 in a mutually parallel arrangement. A distal end 32 of the tying device 14 generally extends outwards from the body 16 beyond the end of the hose barb 24.

Viewed from another perspective, the filling device 10 includes a fill tube 24 and tying device 14 with the fill tube 24 and tying device 14 each connected on a distal end of the body 16 opposite the coupler 20 on a proximal end. Under this view, the fill tube 24 and tying device 14 are juxtaposed in a spaced apart relationship and where the fill tube 24 and tying device 14 extend outwards from the body 16 in a generally parallel relationship.

Also included within the filling and tying device 10 is a valve 34. The valve 34 may include a water control button 44 extending from an upper surface of the housing 16 and a shaft 46. The shaft 46, in turn, may be provided with one or more o-rings around a periphery of a far end that alternately block and open the conduit 28. The valve 34 may be used to open and close the internal conduit 28 and, in turn, to connect a pressurized source of water received through the coupler 12 to a balloon through the barb 24.

Figure 4:
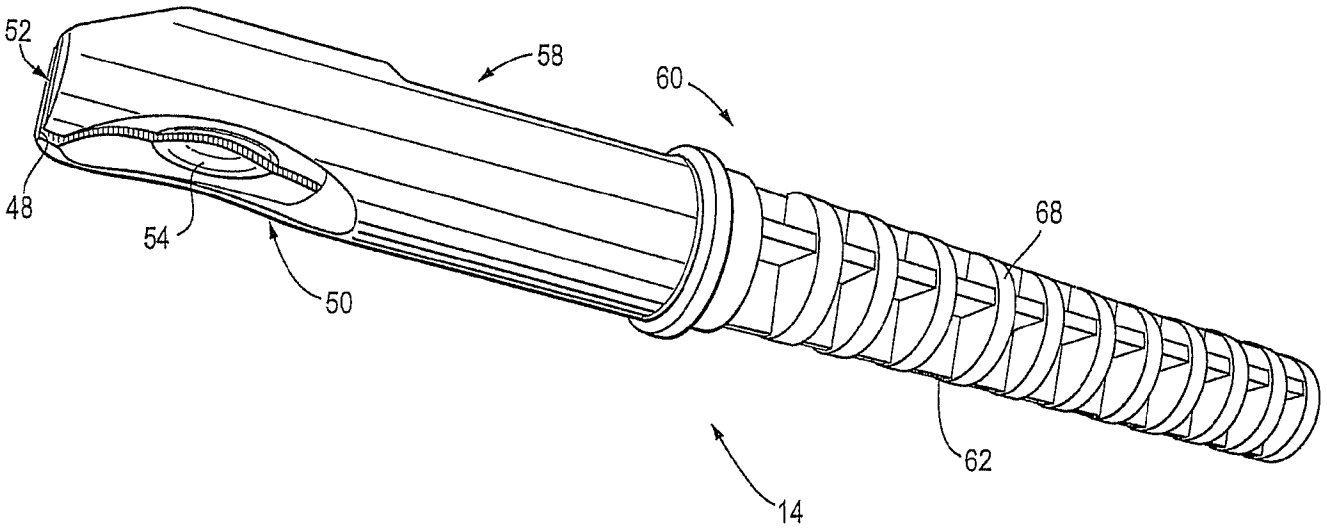
FIG. 4 is a side view of the balloon tying device of FIG. 1.

FIG. 4 is an side view of the tying device 14. As shown in FIG. 4, the tying device 14 includes a proximal end 60 that is inserted into the receptacle 26 and a distal end 58. The proximal end 60 includes a pair of longitudinal ridges 62 on opposing sides of (the cylindrical body) of the tying device 14 that extend along the length of the proximal end 60.

The proximal end also include a set of broken circumferential ridges 68 on opposing sides of the tying device 14 that extend for only a short distance around the circumference (e.g., less than one-half of the circumference on opposing sides). The number of circumferential ridges 68 may be sufficient to cause the set to extend along the length of the proximal end 60.

In contrast, the receptacle 26 is provided with a set of slots 64 that are transverse to the axis of insertion of the device 14 into the receptacle 26 and extending through opposing outside walls of the receptacle 26. The inside surfaces of the receptacle 26 extending back from the entrance are relative smooth and complementary to an outside diameter of the tying device 14 except for the last three slots 64. In this case, three inward-extending snap features may exist either in or between the slots 64. In one case, the receptacle 26 may have ridges in the area between the slots 64 that extend inwards.

To insert the tying device 14, the user may simply insert the tying device 14 until the transverse ridges 68 engage the three snap features. Alternatively, the user may align the longitudinal ridges 62 with the transverse slots 64 and pushes the tying device 14 into the receptacle 26 and then rotates the tying device 14 to cause the snap features (ridges) located between the last three transverse slot 64 to engage the transverse ridges 68 thereby locking the tying device 14 into the body 16 with the slot 52 aligned with the barb 24. To remove the tying device 13, the user may simply twist the tying device 14 or simply pull firmly to dislodge the inside ridges from the area between the transverse ridges 64.

As shown in FIG. 4, the tying device 14 is provided with a slot 52 having a length, a width and a depth. The length of the slot 52 is somewhat longer than a diameter of the cylindrical body of tying device 14 and where the slot 52 extends parallel to and lies between opposing sides of the balloon tying device 14. The width of the slot 52 may be sufficient to easily receive a flattened neck of a balloon. The depth of the slot 52 extends along a longitudinal axis of the device 14 where the depth is defined by the distance from the marginal end 48 of the body to a root 50 of the slot 52. Under one illustrated embodiment, the depth of the slot may be greater than a diameter of the cylindrical body 14.

The slot 52 is also provided with a bevel or taper 54 on one or both facing sides of the slot 52. The bevel 54 is located adjacent the root 50 and is located on an outer diameter of the device 14 on a side of the device 14 that has the greatest relative distance from the barb 24. The bevel 54 extends from the root 50 for a limited distance towards the marginal end 48, but in preferred embodiments not all the way to the marginal end 48. The bevel 54 is provided to receive a rolled over mouth portion on the distal end of the neck of the balloon.

The bevel 54 receives the mouth so that no portion of the mouth is outside of the slot 52. Retaining the mouth within the bevel during tying allows the neck to be pulled over the mouth without contacting the mouth.

Figure 5:
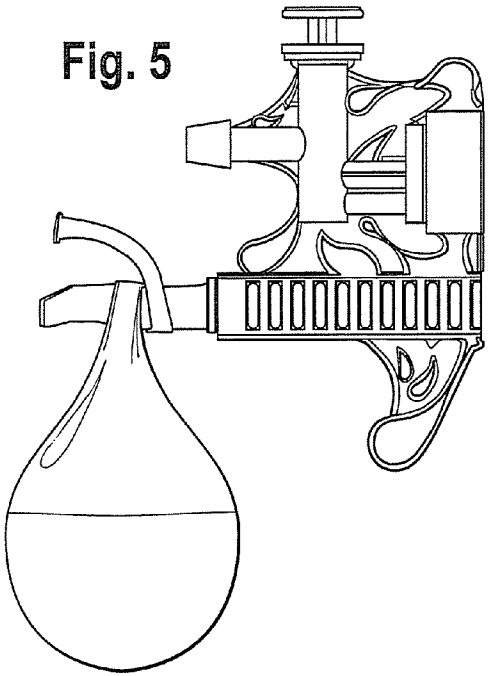
FIGS. 5-9 depicts a set of steps that may be used by the device of FIG. 1 to tie a balloon.

FIGS. 5-9 depict a set of steps that may be used to fill and tie a balloon 22. As a first step, a mouth and a portion of the neck of the balloon 22 may be slipped over the host barb 24 (FIG. 5). Once the mouth of the balloon 22 has engaged the hose barb 24, the valve 34 may be opened, thereby allowing pressurized fluid to inflate the balloon 22.

Figure 6:
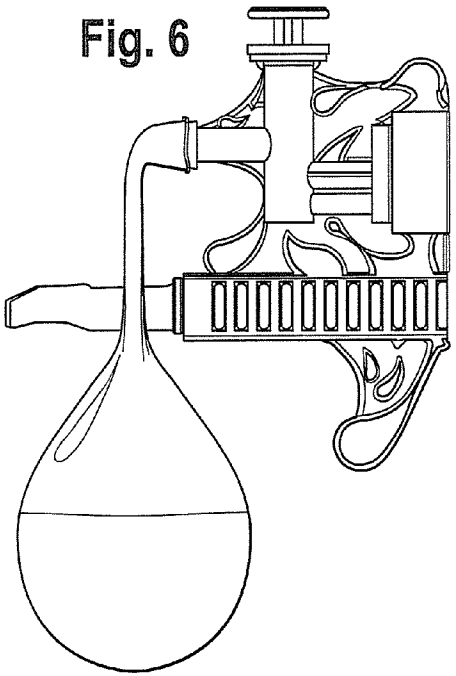
Figure 7:
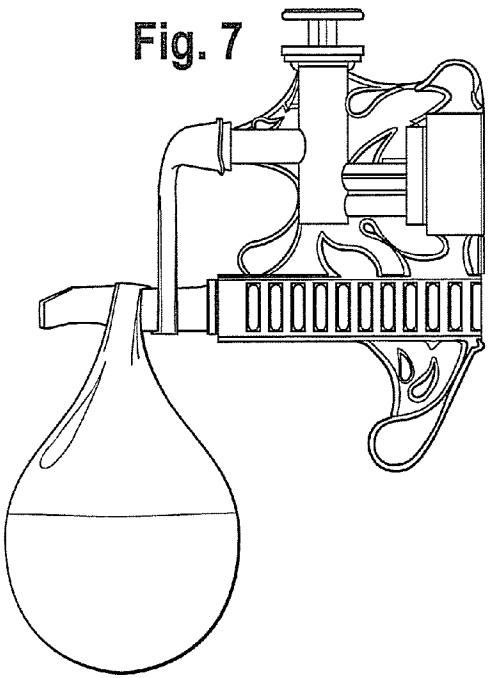

Once the balloon 22 has been inflated, the balloon 22 may be looped around the post 14 as shown in FIG. 6. In the case where the pressurized fluid is water, the balloon may be looped around the balloon tying device 14 by a user simply grasping the body 16 in the palm of the user's hand with the barb 24 extending away from a body of the user and the user may use his/her other hand to wrap the neck of the balloon 22 around the tying device 14. Alternatively, the user may laterally swinging the device 10 is a slow looping motion to cause the balloon 22 to wrap around the balloon tying device 14. In this case, the host barb 24 retains the mouth of the balloon during filling and the looping step without the necessity of the user having to secure the mouth to the hose barb 24.

Figures 8, 9:
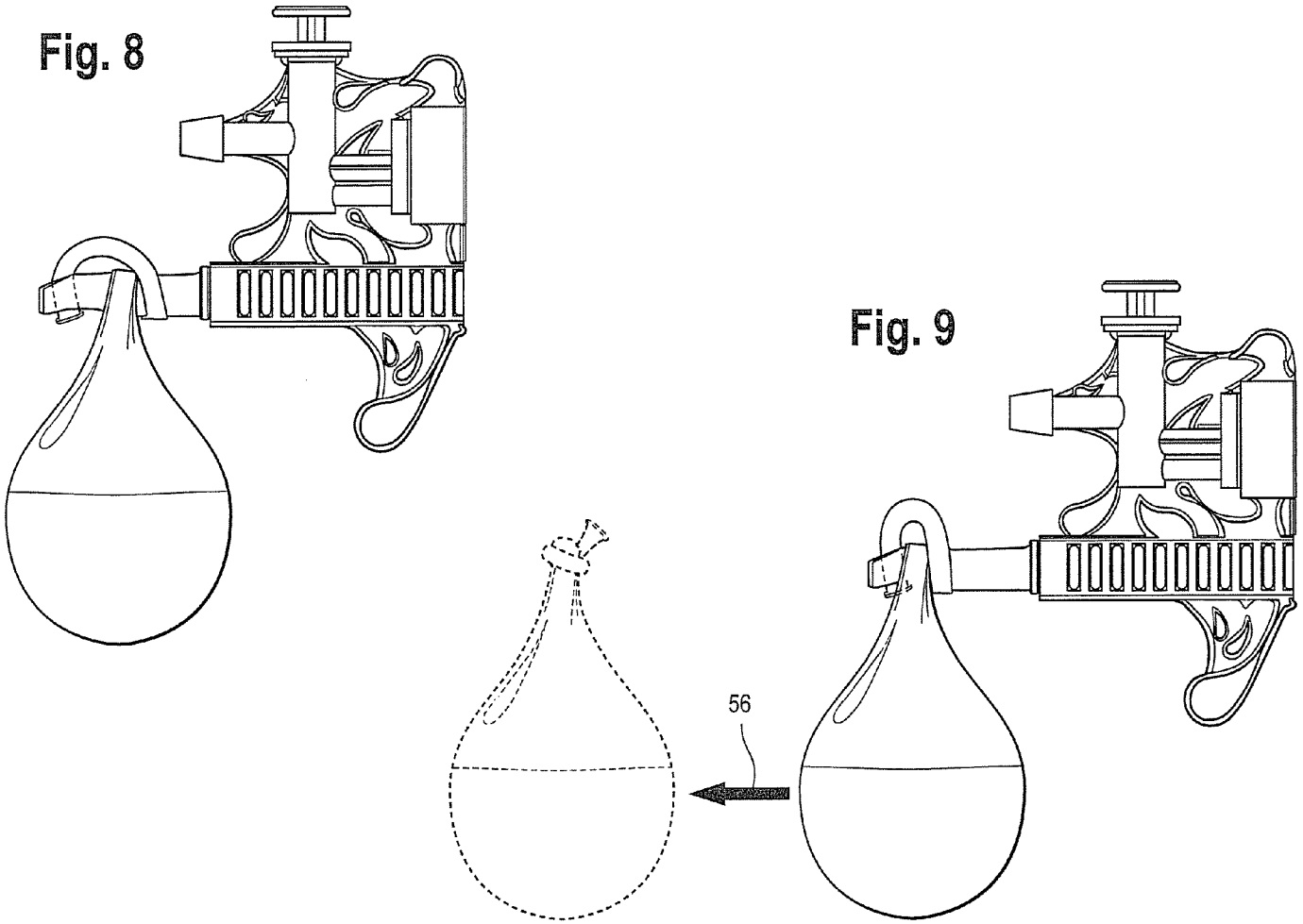

Next, the user may detach the mouth of the balloon from the hose barb 24 (FIG. 7) and pull the mouth over and across the distal end 48 so that the neck of the balloon enters the slot 52 as shown in FIG. 8. When the user releases the mouth of the balloon the resilient nature of the neck of the balloon pulls the mouth into the bevel 54 of the slot 52.

As a final step, the user grasps a body of the balloon 22 and pulls the body away from the device 10 in a direction 56 parallel to the device 14 and away from the device 10 as shown in FIG. 9. As the user pulls on the body of the balloon, the looped neck slides along the balloon tying device 14 towards the distal end 48 while the mouth of the balloon continues to be held in the slot 52. As the looped neck finally slides off the distal end 48 of the body of the typing device 14, the mouth of the balloon continues to be held in the groove thereby completing a knot in the neck of the balloon. Once the looped neck disengages the tying device 14 and the knot is complete, the mouth of the balloon abruptly disengages the slot 52.

As can be seen from the steps of FIGS. 5-9, the tying device 10 allows balloons to be filled and tied with a minimum of effort even for persons with limited dexterity. For example, the device 10 may be held in one hand while the user uses his/her other hand to engage the mouth of the balloon 22 to the barb 24. More specifically, a person may hold the device 10 with the hose 12 in the palm of his/her hand with his/her fingers extending around the device 10 with his/her forefinger on one side of the finger grip 66 and the remaining fingers on the other side of the finger grip 66. This is convenient because the user's thumb is free to control the valve 34 while leaving the user's other hand free to manipulate the balloon 22. In this case, the balloons may be easily and quickly filled and tied with only a limited amount of effort.

A specific embodiment of a balloon filling and tying device has been described for the purpose of illustrating the manner in which the invention is made and used. It should be understood that the implementation of other variations and modifications of the invention and its various aspects will be apparent to one skilled in the art, and that the invention is not limited by the specific embodiments described. Therefore, it is contemplated to cover the present invention and any and all modifications, variations, or equivalents that fall within the true spirit and scope of the basic underlying principles disclosed and claimed herein.

The invention claimed is:

1. A balloon filling device comprising:

a hose connector extending outwards from a body of the balloon filling device;

a hose barb extending outwards from the body along a predominant axis, the hose barb being displaced on the body from the hose connector;

a valve within the body having an opened state where the valve forms a conduit between the hose connector and the hose barb and a closed state where the conduit is blocked; and a receptacle disposed in the body adjacent the hose barb that receives a balloon tying device wherein the hose connector extends outwards from the body on a side of the body opposite the hose barb, parallel to the predominant axis.

2. The balloon filling device as in claim 1 further comprising a valve actuator extending outwards from the body midway between the hose connection and hose barb in a direction perpendicular to the predominant axis.

3. The balloon filling device as in claim 2 further comprising the receptacle being disposed on the body on a side opposite the valve actuator.

4. The balloon filling device as in claim 1 wherein the balloon tying device 14 is removed from the body and used separately for tying balloons.

5. A balloon filling device comprising:

a body of the hose filling device engaging a pressure source;

a hose barb extending outwards from a body along a predominant axis, the hose barb extending from the body parallel to and displaced from the pressure source; and a balloon tying device extending from the body parallel to the predominant axis, the balloon device being detachable from and reattachable to the body without tools or damage.

6. The balloon filling device as in claim 5 wherein the body further comprises a valve within the body having an opened state where the valve forms a conduit between the pressure source and the hose barb and a closed state where the conduit is blocked.

7. The balloon filling device as in claim 6 wherein the body further comprises a receptacle that axially accepts the balloon tying device.

8. The balloon filling device as in claim 7 wherein the balloon tying device is rotated by one-quarter turn within the receptacle to release the balloon tying device from the body.

9. The balloon filling device as in claim 8 wherein the body further comprises a balloon tying device with a set of transverse slots.

10. The balloon filling device as in claim 9 wherein the balloon tying device further comprises a set of circumferential ridges that engage the transverse slots.

11. The balloon filling device as in claim 5 wherein the pressure source further comprises a water hose.

12. The balloon filling device as in claim 5 wherein the balloon tying device 14 is removed from the body and used separately for tying balloons.

13. A balloon filling device comprising:

a body of the balloon filling device;

a hose connector extending outwards from the body along a predominant axis;

a hose barb extending outwards from the body in a direction opposite the hose connector and parallel to the predominant axis;

a valve within the body having an opened state where the valve forms a conduit between the hose connector and the hose barb and a closed state where the conduit is blocked;

a valve actuator extending outwards from the body midway between the hose connection and hose barb in a direction perpendicular to the predominant axis; and a receptacle that receives a balloon tying device on a side of the body that is opposite the valve actuator with an axis of insertion of the balloon tying devices into the receptacle lying parallel to the predominant axis.

14. The balloon filling device as in claim 13 further comprising the balloon tying device.

15. The balloon filling device as in claim 14 wherein the balloon tying device is rotated by one-quarter turn within the receptacle to release the balloon tying device from the body.

16. The balloon filling device as in claim 15 wherein the body further comprises a balloon tying device with a set of transverse slots.

17. The balloon filling device as in claim 16 wherein the balloon tying device further comprises a set of circumferential ridges that engage the transverse slots.

18. The balloon filling device as in claim 13 further comprising a finger grip extending from a side of the body opposite the valve.

19. The balloon filling device as in claim 13 wherein the balloon tying device 14 is removed from the body and used separately for tying balloons.

* * * * *